US005590642A

United States Patent [19]

Borgeson et al.

[11] Patent Number: 5,590,642

[45] Date of Patent: Jan. 7, 1997

[54] CONTROL METHODS AND APPARATUS FOR GAS-FIRED COMBUSTORS

[75] Inventors: Robert A. Borgeson, Cleveland Heights, Ohio; Robert M. Russ, Los Altos Hills, Calif.; Larry A. Lincoln, Milpitas, Calif.; Thomas L. Webster, Piedmont, Calif.; Nir Merry, Albany, Calif.; William W. Bassett, Wheaton, Ill.

[73] Assignee: Gas Research Institute, Chicago, Ill.

[21] Appl. No.: 378,516

[22] Filed: Jan. 26, 1995

[51] Int. Cl.[6] ..... F24H 3/00

[52] U.S. Cl. ..... 126/116 A; 126/110 R; 236/11

[58] Field of Search ..... 126/116 A, 110 R, 126/110 A, 110 E; 236/10, 11

[56] References Cited

U.S. PATENT DOCUMENTS

| | | | |
|---|---|---|---|
| 4,192,641 | 3/1980 | Nakagawa et al. | 431/15 |
| 4,334,855 | 6/1982 | Nelson | 431/20 |
| 4,445,638 | 5/1984 | Connell et al. | 237/8 R |
| 4,533,315 | 8/1985 | Nelson | 431/20 |
| 4,547,150 | 10/1985 | Vereecke | 432/12 |
| 4,583,936 | 4/1986 | Kriegger | 431/1 |
| 4,588,372 | 5/1986 | Torborg | 431/78 |
| 4,676,734 | 6/1987 | Foley | 431/12 |
| 4,688,547 | 8/1987 | Ballard et al. | 126/116 A |
| 4,707,646 | 11/1987 | Thompson et al. | 318/332 |
| 4,729,207 | 3/1988 | Dempsey et al. | 126/112 |
| 5,001,640 | 3/1991 | Matsumoto et al. | 364/426.02 |
| 5,027,789 | 7/1991 | Lynch | 126/116 A |
| 5,037,291 | 8/1991 | Clark | 431/12 |
| 5,112,217 | 5/1992 | Ripka et al. | 431/12 |
| 5,123,080 | 6/1992 | Gillett et al. | 388/934 |
| 5,206,566 | 4/1993 | Yoshida et al. | 318/568.22 |
| 5,248,083 | 9/1993 | Adams et al. | 236/11 |
| 5,307,990 | 5/1994 | Adams et al. | 236/11 |

*Primary Examiner*—Carroll B. Dority
*Attorney, Agent, or Firm*—Dick and Harris

[57] ABSTRACT

A control system for a fluid-fuel burner, such as a furnace for an HVAC system. The furnace has a variable flow of fuel into the burner. In addition, the circulating air blower is also variable. The furnace heat exchanger plenum is maintained at a substantially constant temperature, as a means for providing substantially constant temperature air to the spaces to be heated.

17 Claims, 4 Drawing Sheets

CONTROL METHODS AND APPARATUS FOR GAS-FIRED COMBUSTORS

BACKGROUND OF THE INVENTION

1. Technical Field

The present invention is directed to control systems for burner devices for fluid (liquid and gaseous) fuels, and in particular, to burners used for HVAC systems, such as gas-fired burners for furnaces, boilers, heat pumps and the like.

2. The Prior Art

A variety of control systems have been developed for regulating the operation of burners which utilize fluid fuels. Control systems for HVAC systems, in particular, have been the subject of considerable development.

One approach has been to develop a control system which has, as its goal, absolute maximum combustion efficiency. Such a system is disclosed in Foley, U.S. Pat. No. 4,676,734. The Foley '734 apparatus, which can also be used in ovens or stoves, as well as furnaces and boilers, involves the constant alteration of the amount of input air introduced into the combustion process. The combustion output is then monitored, and used as feedback, for the next alteration of input air. Foley '734 further teaches a furnace configuration in which input air and input fuel appear to be varied, in a limited sense, and which has a fixed temperature output of conditioned air.

Another prior art burner control system is disclosed in Krieger, U.S. Pat. No. 4,583,936. The control in Krieger appears to be accomplished through variation of the duty cycle of the burner. Although the flow rate of fuel into each burner is fixed, the amount of time the burner is "on" is varied, in order to vary the thermal input. Air flow into the burner appears variable.

A characteristic which is common to such control systems is that of the various controllable "independent variables," such as gas input rate, combustion air input rate, circulation air rate (for forced air HVAC systems), at most one of these variables is provided with a control capable of operation in other than fixed modes or settings, or are capable of minute variations, in response to changes in operating conditions, such as changes in building load, room damper or vent configuration, etc.

It is desirable to provide a general control system for gas-fired burner apparatus, such as may be used in gas-fired furnaces, boilers, and the like, the separate components of which are capable of operation in more that just a few fixed settings and so are capable of more responsive operation relative to such changes in building load or other operating conditions and requirements.

SUMMARY OF THE INVENTION

The present invention comprises, in part, an apparatus for causing a circulating heat transfer medium to transfer heat. In particular, the apparatus comprises a burner for fluid fuels, operably connected to a source of fluid fuel; means for modulating the flow of fluid fuel from the source to the burner; means for enabling the transfer of heat from the burner to the heat transfer medium, operably associated with the burner; means for circulating the heat transfer medium from the means for enabling transfer of heat, to a position remote from the burner, for transfer of at least some of the heat from the heat transfer medium, at the remote position, and for circulating the heat transfer medium back to the means for enabling transfer of heat; and means for modulating the operation of the means for circulating the heat transfer medium, for varying the amount of heat transferred from the heat transfer medium.

The apparatus may further comprise means for controlling the means for modulating the flow of fluid fuel and the means for circulating the heat transfer medium.

In a preferred embodiment, the means for modulating the flow of fluid fuels from the source to the burner comprises a modulating gas valve. The modulating gas valve is contemplated to be controlled by a pulse width modulated control signal—although other control signals could be used for operable modulation, including direct current and multi-step functioning valves.

The aforementioned apparatus may also comprise means for supplying combustion air to the burner in amounts substantially in excess of the stoichiometric ratio appropriate for the fluid fuel employed. The means for supplying combustion air to the burner may be operably configured to supply air in a fully modulable manner. Alternatively, the means for supplying combustion air to the burner may be operably configured to supply air in a modulable manner within one of two or more, substantially non-overlapping ranges of flow rate. In a still further alternative, the means for supplying combustion air to the burner may be operably configured to supply air at two fixed rates of flow.

The invention also comprises, in part, an apparatus for controlling operation of a burner for fluid fuels, for heating a heat transfer medium to a desired temperature. In particular, the apparatus is operably connected to a source of fuel and comprises a burner; means for modulating the flow rate of fuel from the source to the burner; a flow path for a heat transfer medium; means for exchanging heat, released in the burner from combustion of the fuel, into the heat transfer medium; means for modulably transporting the heat transfer medium along the flow path; means for monitoring the temperature of the means for exchanging heat; means for monitoring the temperature of the heat transfer medium at a position remote from the means for exchanging heat; control means, operably associated with the temperature monitoring means, the means for variably regulating fuel flow rate, and the means for modulably transporting the heat transfer medium, for substantially simultaneously actuating the means for variably regulating fuel flow rate, and the means for modulably transporting the heat transfer medium, so as to maintain the temperature of the means for exchanging heat within a range of predetermined temperature values.

In the aforementioned embodiment, the flow path for the heat transfer medium directs the heat transfer medium through one or more zones which require temperature control, and a return air plenum is provided to enable circulation of the heat transfer medium from the heat exchanger means to the zones and back to the heat exchanger. The means for monitoring the temperature of the heat transfer medium at a position remote from the heat exchanger comprises temperature sensor means operably disposed in the return heat transfer conduit.

The present invention also comprises a method for controlling the operation of an apparatus for causing a circulating heat transfer medium to transfer heat.

The method comprises the steps of:

providing a burner for fluid fuel, operably connected to a source of fluid fuel;

modulating the flow of fluid fuel from the source to the burner;

enabling the transfer of heat from the burner to the heat transfer medium, by conducting the heat transfer medium in a heat transfer relationship to the burner;

circulating the heat transfer medium, from the means for enabling transfer of heat, to a position remote from the burner, for transfer of at least some of the heat, from the heat transfer medium, at the remote position;

circulating the heat transfer medium back to the means for enabling transfer of heat; and modulating the circulation of the heat transfer medium, for varying the amount of heat transferred from the heat transfer medium. Accordingly, it is contemplated that such a method be applicable for the operation of various HVAC and related equipment, such as furnaces, boilers and hydronic systems, among others.

The step of modulating the flow of fluid fuel from the source to the burner is preferably accomplished with a modulating gas valve. In addition, the step of modulating the flow of fluid fuel further comprises the step of controlling the modulating gas valve with a pulse-width modulated control signal—although other types of modulating control signals, such as direct current, and even multi-step (e.g. greater than 2 steps) functioning valves are also contemplated for use.

The aforementioned method further comprises the step of:

supplying combustion air to the burner in amounts substantially in excess of the stoichiometric ratio appropriate for the fluid fuel employed.

The step of supplying combustion air further comprises the step of supplying the combustion air at one or more fixed flow rates. Alternatively, the step of supplying combustion air further comprises the step of supplying the combustion air in a modulable manner within one or more substantially non-overlapping ranges of flow rate. In a still further alternative, the step of supplying combustion air further comprises the step of supplying the combustion air in a fully modulable manner.

The present invention also comprises a method for controlling operation of a burner for fluid fuels, for heating a heat transfer medium to a desired temperature. The method comprises the steps of:

providing an initial amount of fuel to the burner and igniting the fuel to begin burner operation;

supplying further fuel to the burner at a predetermined initial flow rate;

transferring heat from the burner to the heat transfer medium by passing the heat transfer medium through a heat exchanger heated by the burner;

circulating the heated heat transfer medium along a predetermined flow path;

monitoring the temperature of the heat transfer medium at the heat exchanger, at which heat from the burner is transferred to the circulating heat transfer medium;

monitoring the temperature of the heat transfer medium at a position remote from the heat exchanger;

substantially simultaneously modulating the rate of supply of the fuel to the burner, and modulating the rate of circulation of the heat transfer medium along the predetermined flow path, so as to control the temperature of the heat transfer medium to a predetermined temperature condition.

In the aforementioned method, the step of monitoring the temperature of the heat transfer medium at a position remote from the means for exchanging heat further comprises the step of:

monitoring the temperature of the heat transfer medium in a return air plenum, after the heat transfer medium has been directed through one or more spaces to be temperature controlled.

BEST MODE FOR PRACTICING THE INVENTION

Figures 1, 2:
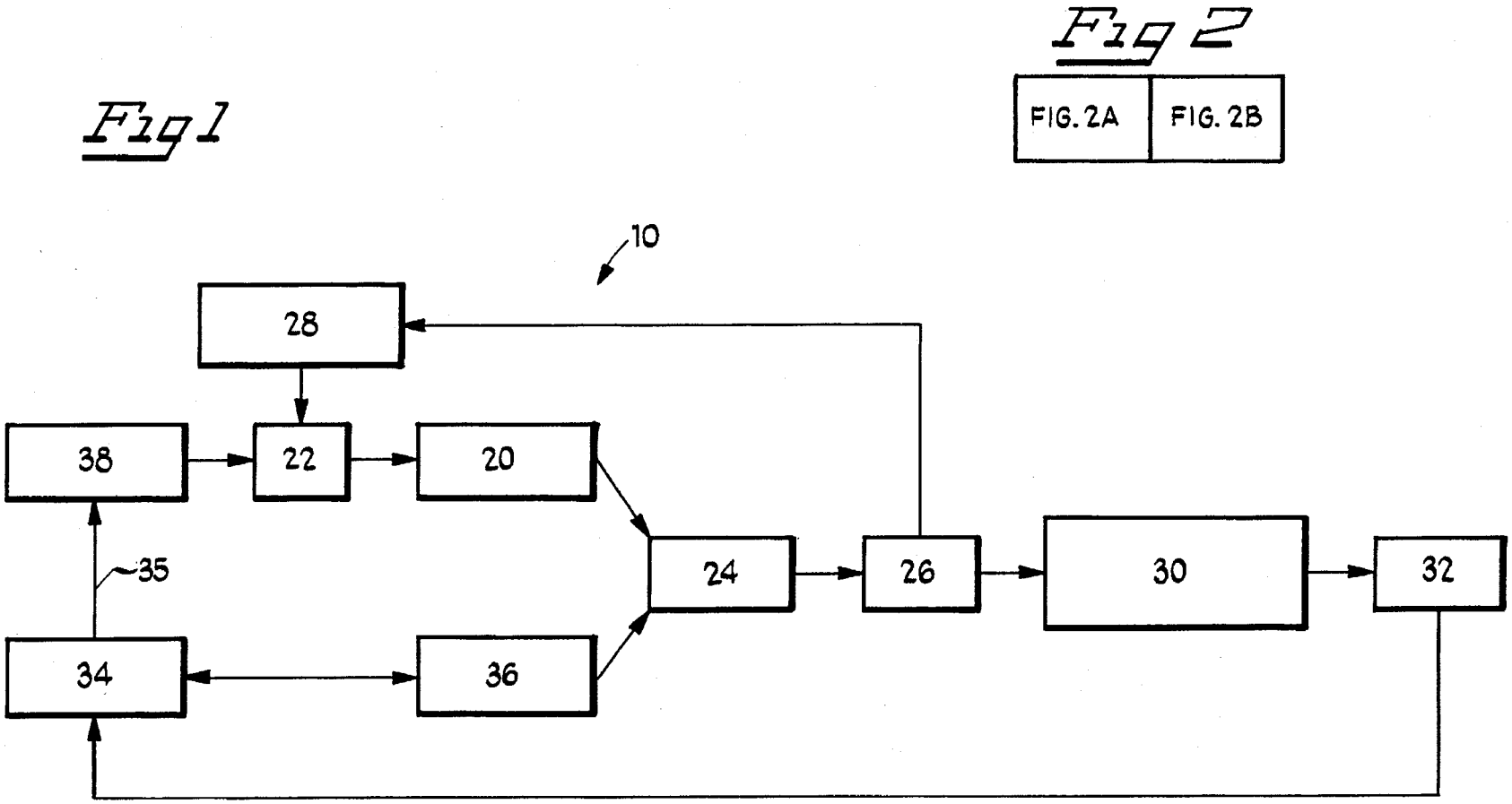
FIG. 1 is a schematic representation of a simplified HVAC control system according to the present invention.
FIG. 2 is a block diagram indicating the respective orientation of FIGS. 2A and 2B.
Figure 2A:
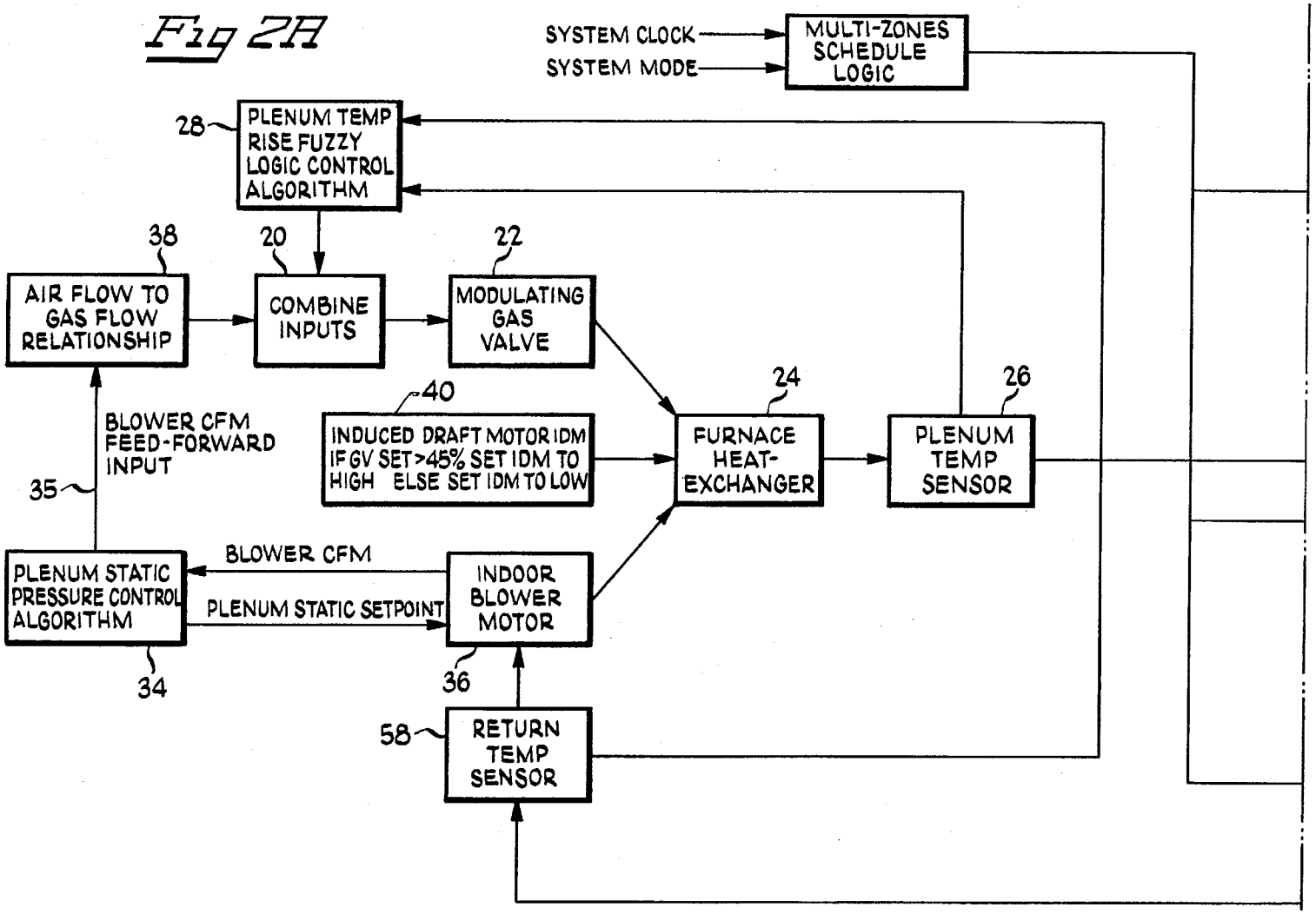
FIG. 2A is a portion of a schematic representation of the control system for a three zone HVAC system.
Figure 2B:
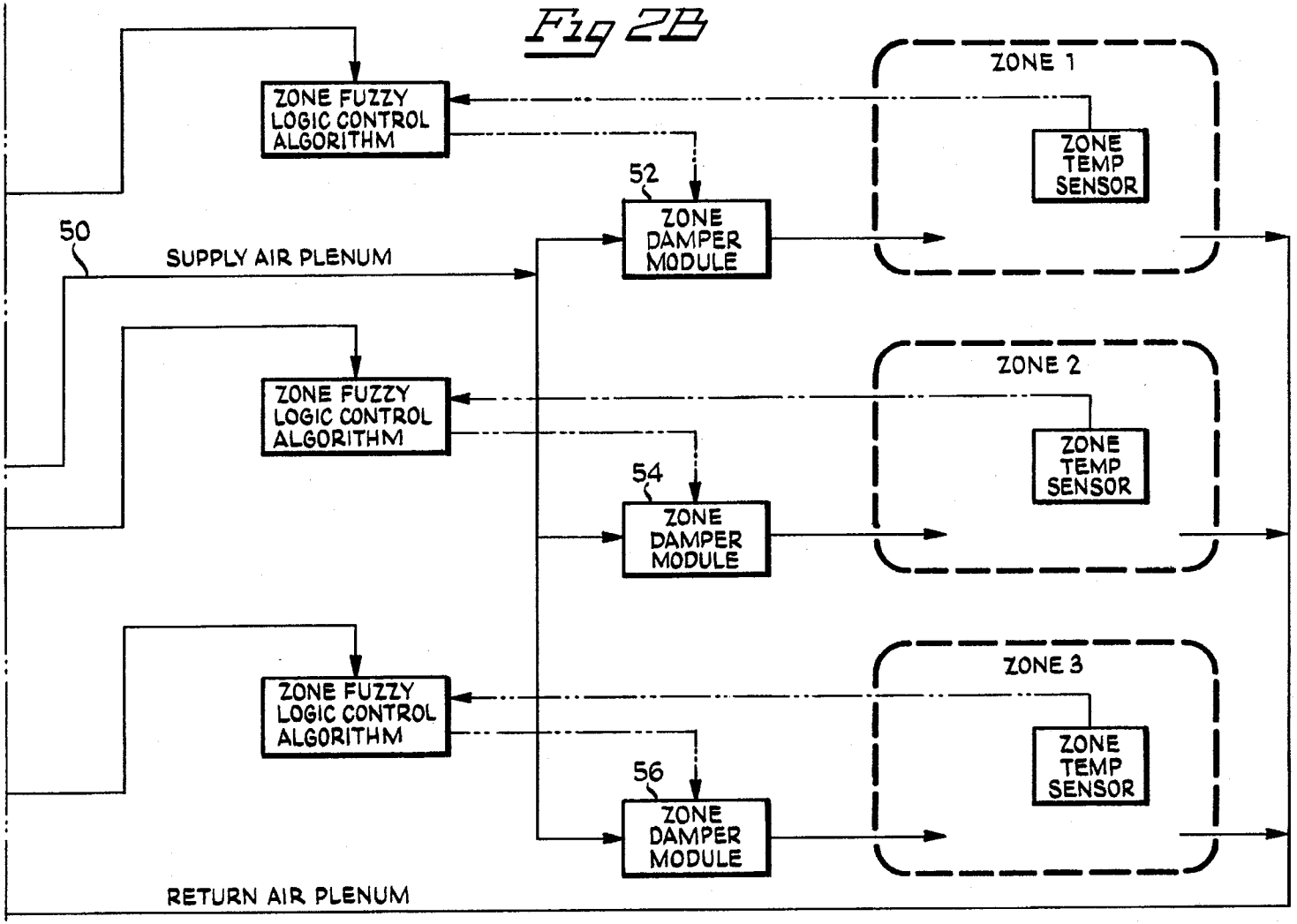
FIG. 2B is another portion of a schematic representation of the control system for a three zone HVAC system.

While the present invention is susceptible to embodiment in many different forms, there is shown in the drawings and will be described herein in detail, several embodiments, with the understanding that the present disclosure is to be considered as an exemplification of the principles of the invention, and is not intended to limit the invention to the embodiments illustrated.

Although the present invention is disclosed in the embodiment of an HVAC system for use, for example, in a residential occupied space, the method and apparatus disclosed herein can also be used in many other applications in which a burner, of fluid fuel, is used to heat a circulating fluid medium.

An apparatus for heating a circulating fluid medium, which employs a gas-fired burner, has numerous principal sources of input which may govern its operation. One such input is the rate at which fuel gas is supplied to the burner. Another is the rate at which combustion air is supplied to the burner. Still another is the rate at which the fluid medium is circulated. The present invention seeks to attain an improved control and performance from such apparatus, by enabling each of these, and other inputs to be controlled through the use of continuous, real-time modulation, in response to exchanging external loads, among other possible factors, as opposed to continuous operation, in which most of these sources of input are fixed or limited to operations at, at most, a few set levels.

For the purposes of the present invention, these principles will be discussed in the environment of a gas-fired, forced air HVAC system, although they are equally applicable to other forms of the apparatus described, such as gas-fired boilers, etc. The concept of modulation, at its core, is employed so that an HVAC system, for example, may act to constantly balance the output of the furnace (or the like) with the average load on the space being conditioned, in response to various varying environmental conditions.

A residential HVAC system (or commercial system) may be provided with a zone type control system, in which a single furnace/air conditioner and blower supply heated/chilled/untreated air to several spaces through a plurality of ducts. The exit of each duct opening in to each space, may be closed, in isolation with respect to the rest of the system, by an automatic damper operating system, in response to the command of a central control system, relative to the output of, among other things, temperature sensors in that space.

When changes in the flow configuration, such as the closing of dampers in a zoned HVAC system, take place, the air flow through the system, and the rate of heat transfer from the furnace plenum, to the circulating air, for example, are also effected. It is a goal of many HVAC systems, to assure that the temperature in the plenum is held constant, since this will help assure that the discharge temperatures at the exits of the ducts are likewise held constant, so that a desired comfort level, once attained, can be maintained.

The present invention includes a method and apparatus for controlling the operation of a gas-fired HVAC system. In a preferred embodiment, the system comprises a gas-fired furnace for a forced-air heating and cooling system. FIG. 1 illustrates a schematic diagram of the control system 10, and the furnace shown in such an example is of the condensing type—although use of non-condensing furnaces, as well as other gas-fired apparatus, are likewise contemplated.

The concept of modulation, as applied to a condensing furnace, forced-air system is as follows: a) the induced draft fan speed (if present) is set to a rate which ensures normal combustion and excess air levels at the maximum fuel input rate (as discussed hereinbelow); b) the induced draft fan speed is kept constant while the fuel input rate is modulated downward, according to changing load on the space being conditioned; c) the circulating air blower is modulated, in order to obtain a balance between plenum air temperature rise, supply air temperature and overall system efficiency.

Figure 3:
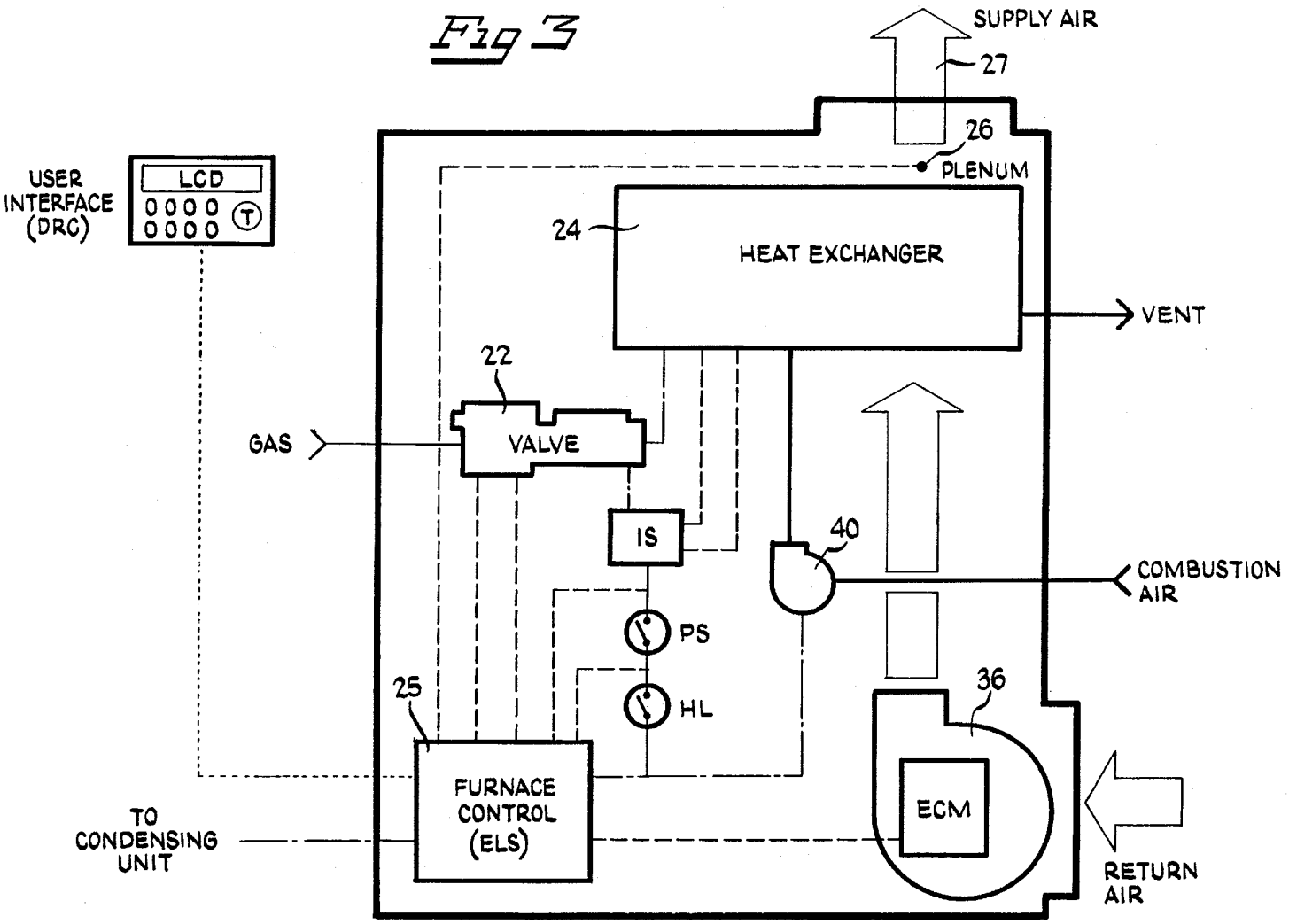
FIG. 3 is a further schematic representation of the furnace component portion of the simplified modulating gas furnace system according to FIG. 1.

In system 10 (FIG. 1 and FIG. 2), control of the combustion process is accomplished by the operation of modulating gas valve 22. The heat from combustion is supplied to plenum heat exchanger 24 (as shown in FIG. 3). In or adjacent to the plenum heat exchanger 24, a sensor 26 is provided which supplies an input to controller 25 (FIG. 3), which is processed with plenum temperature controls using conventionally known fuzzy logic algorithm 28 techniques. The output of the processing of the information from sensor 26, via algorithm 28, is employed to regulate the operation of the modulating gas valve 22.

The heat from plenum heat exchanger 24 is transferred via ducting 27 to the circulating air medium to the space 30 to be heated. Space temperature sensor 32 monitors the temperature in space 30, and the information obtained is processed in the controller via plenum static pressure control algorithm 34. However, it is contemplated that, if desired, for example, in a single zoned system (as opposed to a multi-zoned system) that plenum static pressure control algorithm 34 not be relied upon. Instead, it may be desirable to merely measure the temperature in space 30 directly. From algorithm 34 is obtained information necessary to regulate the operation of indoor blower motor 36, in particular, the desired plenum static pressure which is to be maintained by the blower 36 (and which is sensed by suitably provided pressure sensors in the plenum). In a preferred embodiment, it is contemplated that the algorithm further calculates and, in turn, controls both modulating gas valve 22 and induced draft blower motor 40 to obtain the desired stoichiometric ratio 38. To enable the speed of the circulating air blower 36 to be varied in a substantially infinitely adjustable manner, the motor for the blower must be capable of substantially infinite speed adjustment. Accordingly, an electrically commutated motor (ECM), as are presently known in the art, would, among other commercially available motors, comprise an acceptable motor for use.

Modulating gas valve 22 is shown in FIG. 2 and FIG. 3 as being controlled in a relationship based upon the speed of the indoor blower motor 36, and the feedback information supplied by plenum temperature sensor 26. The results of algorithms 28 and 38 are combined (at 20; FIG. 2) to provide control of the modulating gas valve. The modulating gas valve 22 is coupled to indoor blower motor 36 via a feed forward loop 35 (FIG. 2). A fuzzy logic control loop, using conventionally known fuzzy logic programming techniques, biases the valve output based on feedback from the plenum temperature sensor 26.

The gas valve feed forward equation (within feed forward loop 35) is defined as:

GAS FF %=GV MIN+(GV MAX—GV MIN)×((IBM OUTPUT—IBM MIN)/(IBM MAX—IBM MIN)), in which:

FF % is the valve setting in % of full opening;

GV MIN is a minimum gas valve setting (computation based on furnace size and valve manufacturer data);

GV MAX is a maximum gas valve setting (computation based on furnace size and valve manufacturer data);

IBM OUTPUT is the sensed indoor blower motor speed;

IBM MAX is the maximum indoor blower motor speed;

IBM MIN is the minimum indoor blower motor speed.

The gas valve output is the sum of the feed forward equation and an offset provided by the fuzzy logic, which, in a preferred embodiment, may be ±10%. The gas valve output equation therefore is:

$$\text{GAS OUTPUT } \% = GV\ FF\% + GV\ \text{FUZZY}.$$

The actual valve which will be used for gas modulation may be a solenoid-operated valve of known design of the type in which the percentage of opening is proportional to the DC voltage applied to the solenoid coil. The present invention, in part, may utilize a solenoid-type gas valve, in which the DC modulating coil is governed through the use of a Pulse Width Modulated signal. In a modulating gas valve, the output gas pressure is varied in direct relation to the current passing through the modulating coil. In prior art gas valves, such a valve is driven by varying an analog voltage across the modulating coil, typically requiring elaborate digital-to-analog circuitry. The present invention requires no analog circuitry, has comparable control, and more linear operation with less hysteresis, as compared to the prior art method.

Although other valve specifications may be employed, it is contemplated that, in a preferred embodiment of the invention, and for example, in furnaces operating in the range of 75–120K BTU, a valve operating in the pressure ranges of 2.5"–5.0" water column (W.C.), and 5.0"–12.0" W.C. may be utilized. Indeed, it is contemplated that an appropriate commercially available valve, such as from White Rodgers of Missouri (a division of Emerson Electric), will have an output gas pressure which will be proportional to an average D.C. voltage applied to its modulating coil. Furthermore, the voltage applied to the modulating coil of the valve may be a constant frequency pulse-width-modulated (PWM) rectangular waveform, having a duty cycle modulated between 0%-on and 100%-on, wherein the frequency of the waveform may be 1200 Hz ±5%—although as will be understood to those, having ordinary skill in the art, valves having modulating coils with other operating specifications are likewise contemplated for use. In a preferred embodiment of the invention, the modulation range of the signal controlling the coil may be 50%–100% PWM.

In such an embodiment, the instantaneous on-period voltage and steady-state 100%-on duty cycle voltage is contemplated to be 18 VDC; wherein the gas valve will be configured to be fully open at 16.2 VDC or greater, continuously applied, while full closing of the valve will take place if the voltage falls below 3.00 VDC continuous. However, it will be understood that other voltages and/or current for opening and closing the valve are contemplated—depending on, for example, the particular valve so utilized.

The furnace may include two firing modes: a low-fire mode, and a modulating mode. During the low-fire mode, the gas valve is held at its lowest operating point. Low-fire operation is used when, for example, the heating mode is in effect (as opposed to cooling) and the temperature of the space (e.g., room) to be heated is close to, but just below, the set point temperature, for a specified period of time; if the furnace is in a minimum modulation mode, and the room temperature only just exceeds the set point temperature, the furnace may be configured to switch over to low-fire operation. When the valve is held at its lowest operating point (i.e., low-fire), it may, for example, have an output pressure of 0.50±0.03" W.C. Alternatively, if the room temperature is substantially above the set point temperature, or maintains a predetermined value for a specified time, the furnace may shut off entirely.

The modulating mode may be used, or engaged, when the room temperature drops a certain value below the set point temperature, or maintains a certain value below the set point temperature for a specified time period. The criteria for causing switch-over from one mode of operation, to another, may be determined based upon the season, climate, thermal characteristics of the structure and space to be heated/cooled, and the personal preferences of the occupants, as well as efficiency considerations based upon the operating characteristics of the HVAC components being used.

In a preferred embodiment of the invention, from a "furnace-off" state, the furnace may not proceed directly to a "low-fire" mode, but will proceed to "furnace modulation". From the modulation mode, the furnace may switch to off or to low-fire. From the low-fire mode, the furnace may switch to off or modulation.

Also in a preferred embodiment of the invention, the supply of combustion air to the furnace may be regulated by operation of the induced draft blower 40 at one (or more) speeds: a high speed (e.g., 100% of IBM MAX), set if the gas valve setting is greater than a specific value, e.g. 45%; and a lower speed for all gas valve settings below the predetermined specific value. The operation of the blower, in a preferred embodiment of the invention, will be otherwise fixed, once established at the high or low speed.

In any of the embodiments, the possible air-to-fuel mixtures of which the system is capable are intended to be configured so as to provide for an air-rich combustion mixture. Although not the best possible efficiency, an air-rich mixture may be preferred for several reasons, including more complete combustion, far less pollutants; less likelihood of explosion hazard; less likelihood of toxic fume hazard. For example, during high firing rates, the percentage of excess air may be in the order of 30%, while during "low-fire" operations, the percentage of excess air will be substantially higher.

A schematic representation of a more complex system, is shown in FIG. 2 wherein the system includes three zones 101–103 (zone 1, zone 2, and zone 3, respectively), wherein the zones may be temperature controlled substantially independently of each other. For ease in illustration and understanding, elements in the system of FIG. 2 which are the same as or similar to elements in the system of FIG. 1 and FIG. 3 have been given like reference numerals.

Each of zones 1, 2 and 3 have their own damper 52, 54, 56, respectively, which may serve to isolate that particular zone from the flow coming from supply air plenum 50. A return air flow temperature sensor 58 provides a portion of the input for the fuzzy logic circuit 28, instead of the individual space sensor 32 used in the system of FIG. 1.

In prior art zoned systems employing a furnace, the speed of the circulating air fan was not modulated, but was kept constant at full speed. Indeed, the bypass damper was utilized to divert a portion of the heated circulating air back toward the furnace plenum, or, for example, simply dumped to an unused room, instead of being delivered to any of the heated zones. Indeed, during periods of reduced zone loads, the damper was operated so as to put more of the heated air into the unused room.

In the embodiment of the present invention, however, non-condensing furnaces can also benefit from modulation, through the installation of a modulating gas valve, and through the installation of an appropriate ECM for driving the circulating air blower. Furthermore, in such foregoing embodiments, the induced draft blower, supplying combustion air to the furnace, has been disclosed as being at one of two fixed rates, selected to ensure that air substantially in excess of the appropriate stoichiometric ratio, for the fuel being used, is always present. In a further alternative embodiment of the invention, variable operation of the induced draft blower is also provided.

An advantage of having an at least somewhat variable induced draft motor, is that it can exert some control over the amount of excess air. While some excess air is always to be present, for the previously mentioned reasons, it is desirable to control the amount of air, since it is well known that excess air negatively impacts the overall efficiency of the furnace, and can also be detrimental to the furnace structure itself. These same principles can also be applied, according to the present invention, to furnaces which employ, instead of an inducer, a power burner. In a still further preferred embodiment, the induced air blower can be configured and suitably controlled so as to be fully modulated over a full range of volumetric flow rates between IBM MAX and IBM MIN.

It will also be understood to those with ordinary skill in the HVAC art, that, although the present invention has been described primarily with respect to various "heating" operations, the invention is also capable of operating in a "cooling" operation (e.g. gas-fired air conditioner).

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

We claim:

1. An apparatus for causing a circulating heat transfer medium to transfer heat and for delivering such heat to a space in response to a heating load being imposed on the space, comprising:

a burner for fluid fuels, operably connected to a source of fluid fuel;

means for modulating the flow of fluid fuel from the source to the burner;

means for enabling the transfer of heat from the burner to the heat transfer medium, operably associated with the burner;

means for circulating the heat transfer medium from the means for enabling transfer of heat, to a position remote from the burner, for transfer of at least some of the heat from the heat transfer medium, at the remote position, and for circulating the heat transfer medium back to the means for enabling transfer of heat; and means for modulating the operation of the means for circulating the heat transfer medium, for varying the amount of heat transferred from the heat transfer medium, the modulation of the fuel flow and the modulation of the circulation of the heat transfer medium each being of operably controlled by control means, between at least three respective rates of operation, other than a zero flow rate, the modulation of the fuel flow and the circulation of the heat transfer medium further being controlled so as to be capable of occurring during a single heating cycle towards a continuous balancing of heat being supplied to the space with heating loads being imposed on the space.

2. The apparatus according to claim 1, wherein the means for modulating the flow of fluid fuels from the source to the burner comprises a modulating gas valve.

3. The apparatus according to claim 2, wherein the modulating gas valve is controlled by a pulse width modulated control signal.

4. The apparatus according to claim 1, further comprising:

means for supplying combustion air to the burner in amounts in excess of the stoichiometric ratio appropriate for the fluid fuel employed.

5. The apparatus according to claim 1, further comprising means for supplying combustion air to the burner.

6. The apparatus according to claim 5, wherein the means for supplying combustion air to the burner is operably configured to supply air in a fully modulating manner.

7. The apparatus according to claim 5, wherein the means for supplying combustion air to the burner is operably configured to supply air in a fully modulating manner within one of two substantially nonoverlapping ranges of flow rate.

8. The apparatus according to claim 5, wherein the means for supplying combustion air to the burner is operably configured to supply air in at least two fixed rates of flow.

9. A method for controlling the operation of an apparatus for causing a circulating heat transfer medium to transfer heat, for delivering heat to a space in response to a heating load being imposed on the space, the method comprising the steps of:

providing a burner for fluid fuel, operably connected to a source of fluid fuel;

modulating the flow of fluid fuel from the source to the burner;

enabling the transfer of heat from the burner to the heat transfer medium, by conducting the heat transfer medium in a heat transfer relationship to the burner;

circulating the heat transfer medium, from the means for enabling transfer of heat, to a position remote from the burner, for transfer of at least some of the heat, from the heat transfer medium, at the remote position;

circulating the heat transfer medium back to the means for enabling heat transfer; and modulating the circulation of the heat transfer medium, for varying the amount of heat transferred from the heat transfer medium, the modulation of the fuel flow and the circulation of the heat transfer medium being operably controlled by control means, between at least three rates of operation, other than a zero flow rate, the modulation of the fuel flow and the circulation of the heat transfer medium further being operably controlled so as to be capable of occurring during a single heating cycle towards a continuous balancing of heat being supplied to the space with heating loads being imposed on the space.

10. The method according to claim 9, wherein the step of modulating the flow of fluid fuel from the source to the burner is accomplished with a modulating gas valve.

11. The method according to claim 10, wherein the step of modulating the flow of fluid fuel further comprises the step of controlling the modulating gas valve with a pulse-width modulated control signal.

12. The method according to claim 9, further comprising the step of:

supplying combustion air to the burner in amounts in excess of the stoichiometric ratio appropriate for the fluid fuel employed.

13. The method according to claim 12, wherein the step of supplying combustion air further comprises the step of supplying the combustion air at one of at least two fixed flow rates.

14. The method according to claim 12, wherein the step of supplying combustion air further comprises the step of supplying the combustion air in a modulable manner within one of at least two substantially non-overlapping ranges of flow rate.

15. The method according to claim 12, wherein the step of supplying combustion air further comprises the step of supplying the combustion air in a fully modulable manner.

16. A method for controlling operation of a burner for fluid fuels, for heating a heat transfer medium to a desired temperature, for delivering heat to a space in response to a heating load being imposed on the space, the method comprising the steps of:

providing an initial amount of fuel to the burner and igniting the fuel to begin burner operation;

supplying further fuel to the burner at a predetermined initial flow rate;

transferring heat from the burner to the heat transfer medium by passing the heat transfer medium through a heat exchanger heated by the burner;

circulating the heated heat transfer medium along a predetermined flow path;

monitoring the temperature of the heat transfer medium at the heat exchanger, at which heat from the burner is transferred to the circulating heat transfer medium;

monitoring the temperature of the heat transfer medium at a position remote from the heat exchanger;

substantially simultaneously modulating the rate of supply of the fuel to the burner, and modulating the rate of circulation of the heat transfer medium along the predetermined flow path, so as to control the temperature of the heat transfer medium to a predetermined temperature condition.

the modulation of the fuel flow and the circulation of the heat transfer medium being operably controlled by control means between at least three rates of operation, other than a zero flow rate, the modulation of the fuel flow and the circulation of the heat transfer medium further being operably controlled so as to be capable of occurring during a single heating cycle towards a continuous balancing of heat being supplied to the space with heating loads being imposed on the space.

17. The method according to claim 16, wherein the step of monitoring the temperature of the heat transfer medium at a position remote from the means for exchanging heat further comprises the step of:

monitoring the temperature of the heat transfer medium in a return heat transfer conduit, after the heat transfer medium has been directed through one or more spaces to be temperature controlled.

* * * * *

US005590642C1

(12) EX PARTE REEXAMINATION CERTIFICATE (7429th)

United States Patent

Borgeson et al.

(10) Number: US 5,590,642 C1

(45) Certificate Issued: Mar. 30, 2010

(54) CONTROL METHODS AND APPARATUS FOR GAS-FIRED COMBUSTORS

(75) Inventors: Robert A. Borgeson, Cleveland Heights, OH (US); Robert M. Russ, Los Altos Hills, CA (US); Larry A. Lincoln, Milpitas, CA (US); Thomas L. Webster, Piedmont, CA (US); Nir Merry, Albany, CA (US); William W. Bassett, Wheaton, IL (US)

(73) Assignee: Varidigm Corporation, Plymouth, MN (US)

Reexamination Request:
No. 90/009,407, Feb. 18, 2009

Reexamination Certificate for:

| | |
|---|---|
| Patent No.: | **5,590,642** |
| Issued: | **Jan. 7, 1997** |
| Appl. No.: | **08/378,516** |
| Filed: | **Jan. 26, 1995** |

(51) Int. Cl.
*F24H 9/20* (2006.01)
*F24H 3/00* (2006.01)

(52) U.S. Cl. ..... 126/116 A; 126/110 R; 236/11

(58) Field of Classification Search ..... None
See application file for complete search history.

(56) References Cited

U.S. PATENT DOCUMENTS

| | | | | |
|---|---|---|---|---|
| 3,650,262 | A | | 3/1972 | Root et al. |
| 3,999,934 | A | * | 12/1976 | Chambers et al. ..... 431/63 |
| 4,251,025 | A | | 2/1981 | Bonne et al. |
| 4,334,855 | A | * | 6/1982 | Nelson ..... 126/116 A |
| 4,340,355 | A | | 7/1982 | Nelson et al. |
| 4,403,599 | A | | 9/1983 | Copenhaver |
| 4,468,192 | A | | 8/1984 | Jaeger |
| 4,483,672 | A | | 11/1984 | Wallace et al. |
| 4,547,144 | A | | 10/1985 | Dietiker et al. |
| 4,645,450 | A | | 2/1987 | West |
| 4,677,357 | A | | 6/1987 | Spence et al. |
| 4,706,881 | A | | 11/1987 | Ballard |
| 4,708,636 | A | | 11/1987 | Johnson |
| 4,830,600 | A | | 5/1989 | VerShaw et al. |
| 4,976,459 | A | | 12/1990 | Lynch |
| 4,982,721 | A | | 1/1991 | Lynch |
| 4,994,959 | A | | 2/1991 | Ovenden et al. |
| 5,083,546 | A | | 1/1992 | Detweiler et al. |
| 5,248,083 | A | * | 9/1993 | Adams et al. ..... 236/11 |
| 5,395,230 | A | | 3/1995 | Ferguson |
| 5,601,071 | A | | 2/1997 | Carr et al. |
| 5,634,786 | A | | 6/1997 | Tillander |
| 5,644,068 | A | | 7/1997 | Okamoto et al. |
| 5,779,466 | A | | 7/1998 | Okamura |
| 5,819,721 | A | | 10/1998 | Carr et al. |

FOREIGN PATENT DOCUMENTS

| | | |
|---|---|---|
| JP | 63-263318 | 10/1988 |
| JP | 63-263319 A | 10/1988 |
| JP | 06-174381 | 6/1994 |
| JP | 07-233936 | 9/1995 |

OTHER PUBLICATIONS

"Adjustment Instructions & Wiring Diagrams for Solid State Blower Motor Speed Control," w/ Honeywell Solid State Handbooks, all believed to be published prior to Jan. 26, 1994, 24 pages.
"New Imperial Gas Furnace," Rheem Manufacturing Company, 1970.
"Solid State Breakthrough," Rheem Manufacturing Company 1969.

* cited by examiner

*Primary Examiner*—Peter C. English

(57) ABSTRACT

A control system for a fluid-fuel burner, such as a furnace for an HVAC system. The furnace has a variable flow of fuel into the burner. In addition, the circulating air blower is also variable. The furnace heat exchanger plenum is maintained at a substantially constant temperature, as a means for providing substantially constant temperature air to the spaces to be heated.

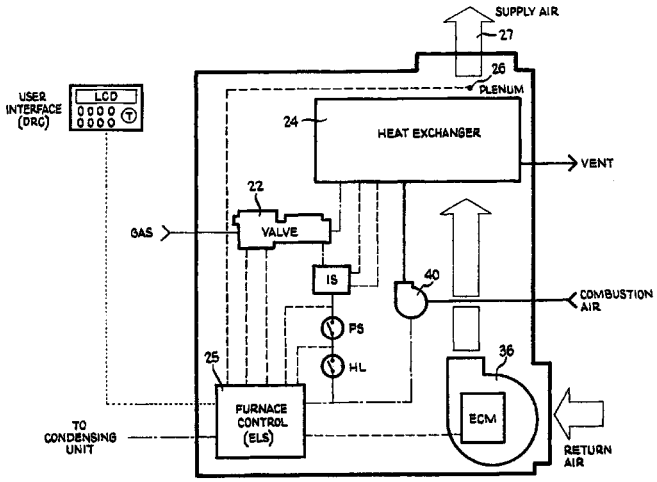

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 5, 8 and 13 are cancelled.

Claims 1, 4, 6, 7, 9 and 14–16 are determined to be patentable as amended.

Claims 2, 3, 10–12 and 17, dependent on an amended claim, are determined to be patentable.

New claims 18–23 are added and determined to be patentable.

1. An apparatus for causing a circulating heat transfer medium to transfer heat and for delivering such heat to a space in response to a heating load being imposed on the space, comprising:

a burner for fluid fuels, operably connected to a source of fluid fuel;

means for modulating the flow of fluid fuel from the source to the burner;

means for enabling the transfer of heat from the burner to the heat transfer medium, operably associated with the burner;

means for circulating the heat transfer medium from the means for enabling transfer of heat, to a position remote from the burner, for transfer of at least some of the heat from the heat transfer medium, at the remote position, and for circulating the heat transfer medium back to the means for enabling transfer of heat; [and]

means for modulating the operation of the means for circulating the heat transfer medium, for varying the amount of heat transferred from the heat transfer medium*; and*

*a modulating blower modulating a supply of combustion air to the burner*, the modulation of the fuel flow[and], the modulation of the circulation of the heat transfer medium*, and the modulation of the combustion air* each being [of] operably controlled by control means, between at least three respective rates of operation, other than a zero flow rate, the modulation of the fuel flow*, the combustion air,* and the circulation of the heat transfer medium further being controlled so as to be capable of occurring during a single heating cycle towards a continuous balancing of heat being supplied to the space with heating loads being imposed on the space.

4. The apparatus according to claim 1, [further comprising:

means for supplying] *wherein the modulating blower supplies* combustion air to the burner in amounts in excess of the stoichiometric ratio appropriate for the fluid fuel employed.

6. The apparatus according to claim [5] *1*, wherein the [means for supplying combustion air to the burner] *modulating blower* is operably configured to supply air in a fully modulating manner.

7. The apparatus according to claim [5] *1*, wherein the [means for supplying combustion air to the burner] *modulating blower* is operably configured to supply air in a fully modulating manner within one of [two] *three* substantially nonoverlapping ranges of flow rate.

9. A method for controlling the operation of an apparatus for causing a circulating heat transfer medium to transfer heat, for delivering heat to a space in response to a heating load being imposed on the space, the method comprising the steps of:

providing a burner for fluid fuel, operably connected to a source of fluid fuel;

modulating the flow of fluid fuel from the source to the burner;

enabling the transfer of heat from the burner to the heat transfer medium, by conducting the heat transfer medium in a heat transfer relationship to the burner;

circulating the heat transfer medium, from the means for enabling transfer of heat, to a position remote from the burner, for transfer of at least some of the heat, from the heat transfer medium, at the remote position;

circulating the heat transfer medium back to the means for enabling heat transfer; [and]

modulating the circulation of the heat transfer medium, for varying the amount of heat transferred from the heat transfer medium*;*

*supplying combustion air to the burner; and*

*modulating a blower to modulate the supply of combustion air to the burner*, the modulation of the fuel flow*, the blower,* and the circulation of the heat transfer medium being operably controlled by control means, between at least three rates of operation, other than a zero flow rate, the modulation of the fuel flow*, the blower,* and the circulation of the heat transfer medium further being operably controlled so as to be capable of occurring during a single heating cycle towards a continuous balancing of heat being supplied to the space with heating loads being imposed on the space.

14. The method according to claim 12, wherein the step of [supplying combustion air] *modulating the blower* further comprises the step of supplying the combustion air in a modulable manner within one of at least [two] *three* substantially non-overlapping ranges of flow rate.

15. The method according to claim 12, [wherein the step of supplying combustion air further comprises the step of supplying the combustion air] *further comprising modulating the blower* in a fully modulable manner.

16. A method for controlling operation of a burner for fluid fuels, for heating a heat transfer medium to a desired temperature, for delivering heat to a space in response to a heating load being imposed on the space, the method comprising the steps of:

providing an initial amount of fuel to the burner and igniting the fuel to begin burner operation;

supplying further fuel to the burner at a predetermined initial flow rate;

*modulating a blower to modulate a supply of combustion air to the burner;* transferring heat from the burner to the heat transfer medium by passing the heat transfer medium through a heat exchanger heated by the burner;

circulating the heated heat transfer medium along a predetermined flow path;

monitoring the temperature of the heat transfer medium at the heat exchanger, at which heat from the burner is transferred to the circulating heat transfer medium;

monitoring the temperature of the heat transfer medium at a position remote from the heat exchanger;

substantially simultaneously modulating the rate of supply of the fuel to the burner, and modulating the rate of circulation of the heat transfer medium along the predetermined flow path, so as to control the temperature of the heat transfer medium to a predetermined temperature condition[.], the modulation of the fuel flow, *the blower,* and the circulation of the heat transfer medium being operably controlled by control means between at least three rates of operation, other than a zero flow rate, the modulation of the fuel flow, *the combustion air,* and the circulation of the heat transfer medium further being operably controlled so as to be capable of occurring during a single heating cycle towards a continuous balancing of heat being supplied to the space with heating loads being imposed on the space.

*18. The apparatus according to claim 1, wherein the control means for the modulation of the fuel flow receives an input signal from a sensor in or adjacent the means for enabling the transfer of heat.*

*19. The apparatus according to claim 1, wherein the apparatus has two firing modes, a first of the two firing modes being a low-fire mode and a second of the two firing modes being a modulating mode.*

*20. The apparatus according to claim 1, wherein the control means for the modulation of the circulation of the heat transfer medium receives an input signal from a sensor in the space.*

*21. The apparatus according to claim 1, wherein the modulating blower comprises an induced draft blower.*

*22. The apparatus according to claim 2, wherein the control means applies a fuzzy logic algorithm to process an input signal to obtain an output signal that regulates the modulating gas valve.*

*23. A method for controlling operation of a burner for fluid fuels, for heating a heat transfer medium to a desired temperature, for delivering heat to a space in response to a heating load being imposed on the space, the method comprising the steps of:*

*providing an initial amount of fuel to the burner and igniting the fuel to begin burner operation;*

*supplying further fuel to the burner at a predetermined initial flow rate;*

*transferring heat from the burner to the heat transfer medium by passing the heat transfer medium through a heat exchanger heated by the burner;*

*circulating the heated heat transfer medium along a predetermined flow path;*

*monitoring the temperature of the heat transfer medium at the heat exchanger, at which heat from the burner is transferred to the circulating heat transfer medium;*

*monitoring the temperature of the heat transfer medium at a position remote from the heat exchanger, wherein the step of monitoring the temperature of the heat transfer medium at a position remote from the means for exchanging heat further comprises the step of: monitoring the temperature of the heat transfer medium in a return heat transfer conduit, after the heat transfer medium has been directed through one or more spaces to be temperature controlled;*

*substantially simultaneously modulating the rate of supply of the fuel to the burner, and modulating the rate of circulation of the heat transfer medium along the predetermined flow path, so as to control the temperature of the heat transfer medium to a predetermined temperature condition,*

*the modulation of the fuel flow and the circulation of the heat transfer medium being operably controlled by control means between at least three rates of operation, other than a zero flow rate,*

*the modulation of the fuel flow and the circulation of the heat transfer medium further being operably controlled so as to be capable of occurring during a single heating cycle towards a continuous balancing of heat being supplied to the space with heating loads being imposed on the space.*

* * * * *